United States Patent [19]

Auerbach

[11] Patent Number: 4,874,176

[45] Date of Patent: Oct. 17, 1989

[54] THREE-DIMENSIONAL PUZZLE

[76] Inventor: Seymour Auerbach, 115 Hesketh St., Chevy Chase, Md. 20015

[21] Appl. No.: 32,343

[22] Filed: Mar. 31, 1987

[51] Int. Cl.[4] ..... A63F 9/12

[52] U.S. Cl. ..... 273/157 R; 446/118; 446/124; 446/127

[58] Field of Search ..... 273/156, 157 R; 446/118, 124, 127

[56] References Cited

U.S. PATENT DOCUMENTS

| | | | |
|---|---|---|---|
| 173,988 | 2/1876 | Nichols | 273/157 UX |
| 941,680 | 11/1909 | Houghton | 273/157 R |
| T984,007 | 7/1979 | Richardson | 273/157 R |
| 1,531,542 | 3/1925 | Cogshall | 273/157 R X |
| 1,573,358 | 2/1926 | Ross | 273/157 R X |
| 1,960,216 | 5/1934 | Schacht | 273/157 R |
| 1,964,007 | 6/1934 | Parks | 273/157 R |
| 2,201,724 | 5/1940 | Gable | 273/157 R |
| 2,493,697 | 1/1950 | Raczkowski | 273/157 R X |
| 2,674,813 | 4/1954 | Hutchinson | 273/157 R UX |
| 3,107,918 | 10/1963 | Edlen | 273/157 R |
| 3,451,681 | 6/1969 | Rossetti | 273/157 R |
| 3,495,833 | 2/1970 | Wesley | 273/157 R |
| 3,578,331 | 5/1971 | DeGast | 273/157 R |
| 3,682,479 | 0/1972 | Miller et al. | 273/157 R |
| 3,779,558 | 12/1973 | Moreau | 273/157 R |
| 3,981,506 | 9/1976 | Daniel et al. | 273/157 R |
| 4,040,630 | 8/1977 | Brattain | 273/157 R |
| 4,177,993 | 12/1979 | Crosby et al. | 273/160 |
| 4,257,606 | 3/1981 | Launzel | 273/157 R |
| 4,332,387 | 6/1982 | Mullen | 273/156 |
| 4,469,331 | 9/1984 | Rinker | 273/157 R |
| 4,583,742 | 4/1986 | Slinn | 273/157 R X |
| 4,597,579 | 7/1986 | Walton | 273/156 |

FOREIGN PATENT DOCUMENTS

| | | | |
|---|---|---|---|
| 688911 | 6/1964 | Canada | 446/92 |
| 318883 | 1/1919 | Fed. Rep. of Germany | 273/157 R |
| 2404376 | 8/1974 | Fed. Rep. of Germany | 273/157 R |
| 2346555 | 3/1975 | Fed. Rep. of Germany | 273/157 R |
| 3440226 | 5/1986 | Fed. Rep. of Germany | 446/124 |
| 755205 | 9/1933 | France | 273/157 R |
| 985673 | 8/1954 | France | 273/157 R |
| 104203 | 2/1917 | United Kingdom | 273/157 R |
| 419311 | 11/1934 | United Kingdom | 273/157 R |
| 476919 | 12/1937 | United Kingdom | 273/157 R |
| 1283061 | 7/1972 | United Kingdom | 446/118 |

*Primary Examiner*—Anton O. Oechsle

*Attorney, Agent, or Firm*—Nixon & Vanderhye

[57] ABSTRACT

A three-dimensional puzzle including puzzle pieces having discrete surfaces, at least one surface of which has a three-dimensional sculpted form whereby the sculpted surfaces in the aggregate upon assembly of the puzzle form a continuous three-dimensional pictorial representation. Abutting sides of the puzzle pieces may be interlocking or three-dimensional for conformal abutting relation with the sides of opposed puzzle pieces. Filler pieces are also provided underlying the puzzle pieces for elevating the sculpted surfaces of the puzzle pieces. The puzzle pieces and filler pieces may be disposed on a base which may have an edge containment whereby non-interlocking puzzle and filler pieces may be used. The puzzle and filler pieces may be vertically interlocked against lateral movement and with respect to the base by projections received in corresponding recesses.

22 Claims, 9 Drawing Sheets

THREE-DIMENSIONAL PUZZLE

BACKGROUND OF AND SUMMARY OF THE INVENTION

The present invention relates to a novel and improved form of table-top puzzle comprising a number of inter-related pieces which, when assembled, has one or more of its surfaces rendered in three-dimensional sculpted form rather than being flat or two-dimensional. The puzzle provides a complex, entertaining and educational experience for the assembler and will result in an aesthetically pleasing three-dimensional shape simulating a natural or man-made object or a patterned surface.

Whereas table-top puzzles, such as jigsaw puzzles, are commonplace, they have heretofore been made more complex, entertaining and stimulating mainly by increasing their size or the number of their pieces, the complexity of the relationship of the separate pieces, or by increasing the complexity of their imprinted surface patterns.

While these methods of making the solution of a puzzle more complicated have been rewarding, it is desirable to further enhance the complexity of such table-top puzzles by imposing a three-dimensionality to the puzzle's pieces, their manner of assembly, and to their final assembled form.

According to the present invention, there is provided a three-dimensional puzzle comprised of a plurality of puzzle pieces, each having discrete surfaces, at least a first of which has a three-dimensional sculpted form, and which sculpted surfaces in the aggregate and upon assembly of the puzzle form a continuous three-dimensional representation. At least a second of the discrete surfaces of each of the puzzle pieces abuts and is conformal with a corresponding second discrete surface of another puzzle piece upon assembly of the puzzle pieces. Means are provided for retaining the puzzle pieces in assembly with the second surfaces of the pieces abutting one another. In this form of the invention, a non-interlocking relation of the puzzle pieces is provided whereby the puzzle pieces having the second surfaces abutting one another are freely laterally movable away from one another absent such retaining means. The absence of tongues or grooves which interlock one with the other, typical of conventional jigsaw puzzles, or other types of retaining means carried by or forming a part of the discrete puzzle pieces, enables the abutting surfaces to be linear or sinuous or of any other non-interlocking shape whereby the complexity of the puzzle may be increased by the absence of clues for its assembly which otherwise would be drawn from the interlocking shapes of the puzzle pieces.

In one form of the foregoing-described invention, the base has an edge containment whereby the puzzle pieces are retained in assembled relation one to the other. Alternatively, the base may have individual captive means to hold the individual puzzle pieces. For example, the base may be formed into an orthagonal grid or other pattern, i.e., curvilinear or geometric, having raised or depressed portions with corresponding depressed or raised portions of overlying puzzle pieces whereby the puzzle pieces may fit into the grid and be restrained from lateral movement. Use of the term "grid" is therefore not limited to orthagonal relationships. With either type of base, i.e., edge containment or a base providing for individual capture of the puzzle pieces, the base may additionally be provided with elevated portions or tiers on which the individual puzzle pieces may be disposed. Additionally, the puzzle may be provided with filler pieces disposed on a flat base or a tiered base, as desired, and on which the individual puzzle pieces having the sculpted surfaces may lie. As a further alternative, portions of the base may be sculpted and elevated to form with the puzzle pieces one or more portions of the three-dimensional pictorial representation. In all of the foregoing embodiments, the puzzle pieces and filler pieces may be retained in assembled relation by the side edge containment of the base or by the individual captive means provided on the base. Additionally, certain ones or all of the puzzle pieces and filler pieces may be provided with interlocking surfaces along their side abutting surfaces to provide the lateral containment.

In a still further alternate form of the present invention, vertical interlocking may be provided between vertically superposed discrete puzzle pieces to prevent lateral shifting of the superposed puzzle pieces. Preferably, each overlying puzzle piece has at least a pair of locking components whereby it may be vertically interlocked with one, two or more underlying puzzle pieces or filler pieces whereby the entire three-dimensional representation may be vertically interlocked to preclude lateral movement of any one or more of the puzzle pieces. In this form, the puzzle may be constructed about a base having an upstanding portion or a number of tiers or from vertically interlocking pieces per se.

While a preferred form of the present invention provides puzzle pieces having non-interlocking sides, interlocking puzzle pieces may likewise be used in certain embodiments hereof. For example, puzzle pieces having tongues and grooves in their abutting sides may be used in combination with a base having raised or elevated tiers or sections, with intermediate filler pieces with or without a base or with sculpted side edges forming the side edges of the puzzle.

In a still further preferred form hereof, interlocking puzzle pieces may be used where the interlocks are hidden from view in final assembly of the puzzle. For example, interlocks having tongues and grooves may be provided which do not extend the full height of the puzzle pieces to their sculpted surfaces. Alternatively, dovetail-type connections adjacent the bases of the pieces may be provided. In this case, edge containment on a base is not necessary to retain the pieces in their assembly.

Additionally, and in another form of the present invention, the support comprises filler pieces for underlying the puzzle pieces for elevating the puzzle pieces to elevate their sculpted surfaces above their elevation without said filler pieces, the elevated puzzle pieces having their sculpted surface forming upon assembly with a plurality of puzzle pieces and the filler pieces being the continuous three-dimensional representation. The filler pieces and puzzle pieces may or may not have interlocking devices on their abutting surfaces.

It will be appreciated that the three-dimensional puzzle hereof may be formed of a wide variety of materials including, but not limited to, wood, plastic, cast metal, cast plaster, hardboard, papier-mache or cast stone, and with or without a surface sheet. That is to say, pictorial representation may be formed on the sculpted surfaces of the individual puzzle pieces by the application of a surface sheet affording pictorial features or the sculpted surfaces may be otherwise treated, for example, painted or imprinted in accordance with the representation to be pictured. In forming the puzzle pieces, they may be molded, or cast and cut, or cast with a surface sheet and then cut. The puzzle pieces may also be cast solid or in hollow form, as desired.

Accordingly, it is a primary object of the present invention to provide a novel and improved three-dimensional puzzle having a number of inter-related pieces which, in assembly, have one or more of their surfaces in a three-dimensional sculpted form to provide a three-dimensional representation.

These and further objects and advantages of the present invention will become more apparent upon reference to the following specification, drawings and claims.

BRIEF DESCRIPTION OF THE DRAWING FIGURES

FIG. 1 is a perspective view of an assembled puzzle constructed in accordance with an embodiment of the present invention showing interlocking puzzle pieces or segments without a base;

FIGS. 2, 2*a*, 3 and 3*a* are cross-sectional views taken about on lines 2—2, 2*a*—2*a*, 3—3 and 3*a*—3*a* in FIG. 1;

FIG. 4 is a perspective view of another embodiment of an assembled puzzle constructed in accordance with the present invention illustrating puzzle pieces in abutting non-interlocking relation and without a base;

FIGS. 5, 6 and 6*a* are cross-sectional views taken about on lines 5—5, 6—6 and 6*a*—6*a* in FIG. 4;

FIG. 5*a* is a view similar to FIG. 5 and illustrating a further form of the invention.

FIG. 7 is a perspective view of a partially assembled puzzle constructed in accordance with a still further form of the present invention illustrating puzzle pieces, with filler pieces and a base with a containing edge;

FIGS. 8 and 8*a* are cross-sectional views thereof taken generally about on lines 8—8 and 8*a*—8*a* in FIG. 7;

FIGS. 9 and 9*a* are views similar to FIGS. 8 and 8*a* but showing alternative forms of the invention;

Figure 14:
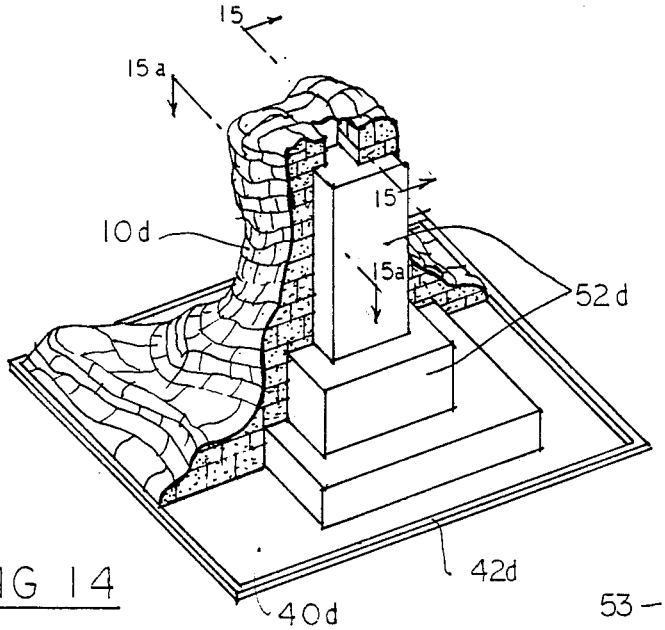
FIG. 14 is a perspective view with parts broken out and in cross-section of a partially assembled puzzle constructed in accordance with a further embodiment of the present invention.
Figure 17:
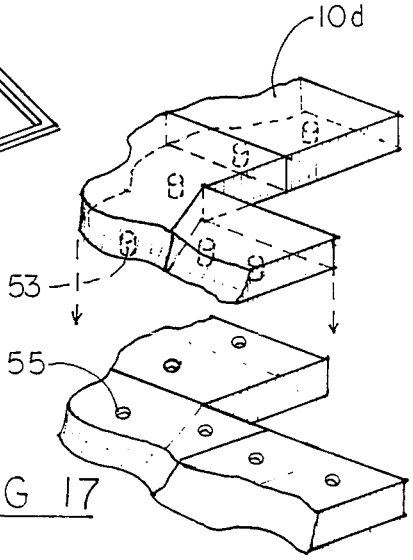
Figure 15:
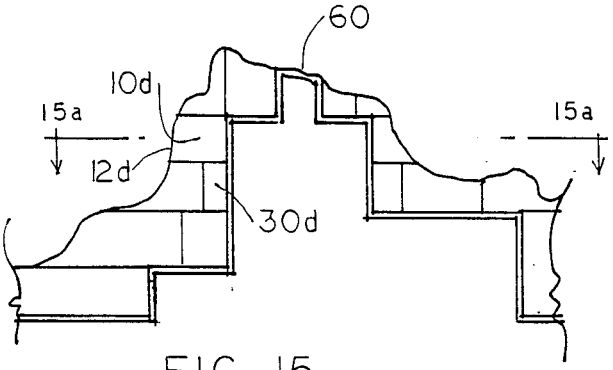
FIG. 15 is an enlarged fragmentary cross-sectional view thereof taken generally about on line 15—15 in FIG. 14.
Figure 16:
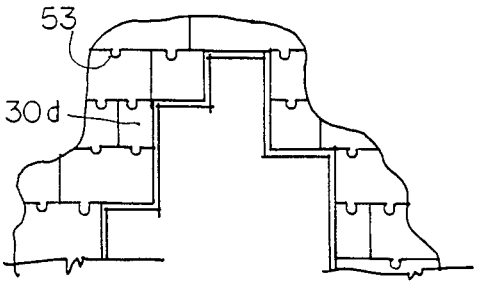
Figure 15A:
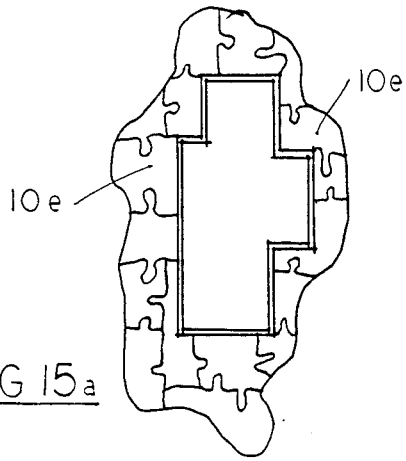
Figure 16A:
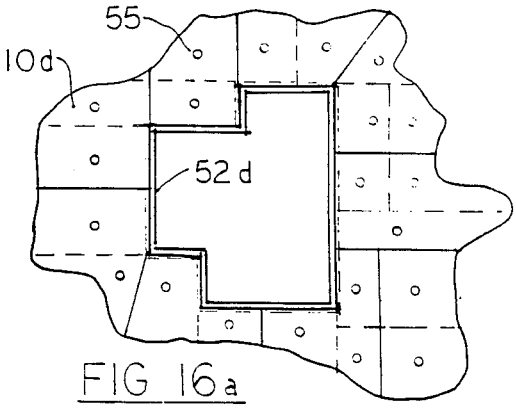
Figure 18:
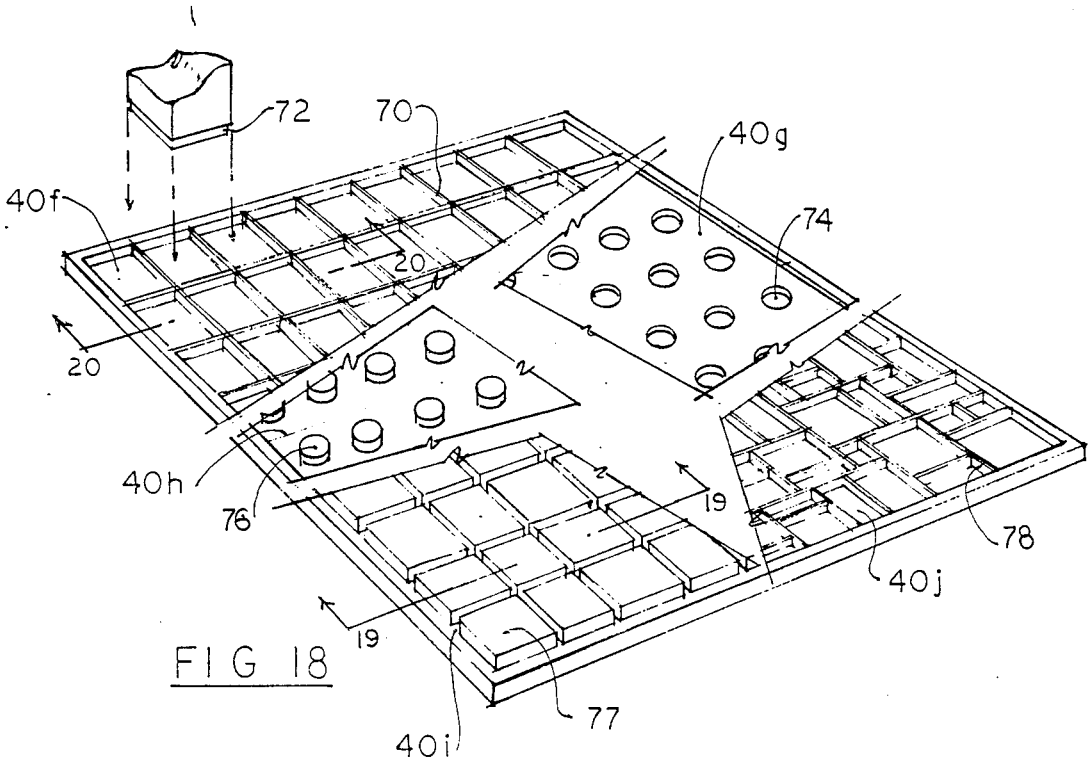
Figure 22:
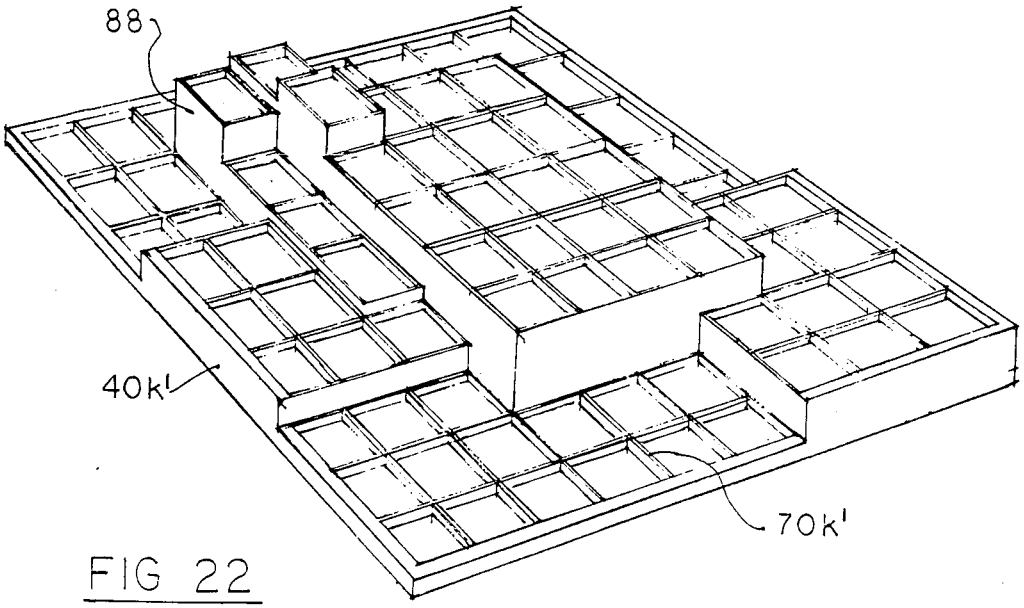
Figure 23:
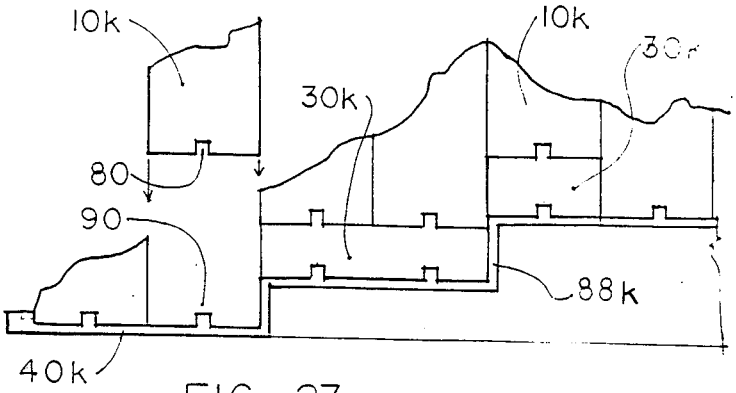
Figure 24:
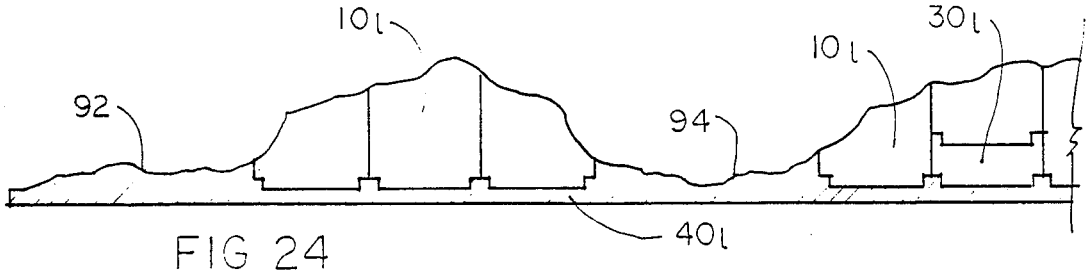
Figure 25:
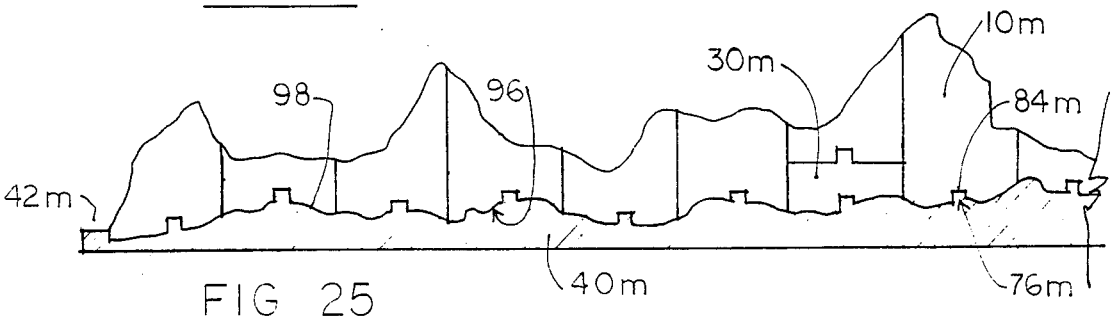
Figure 26:
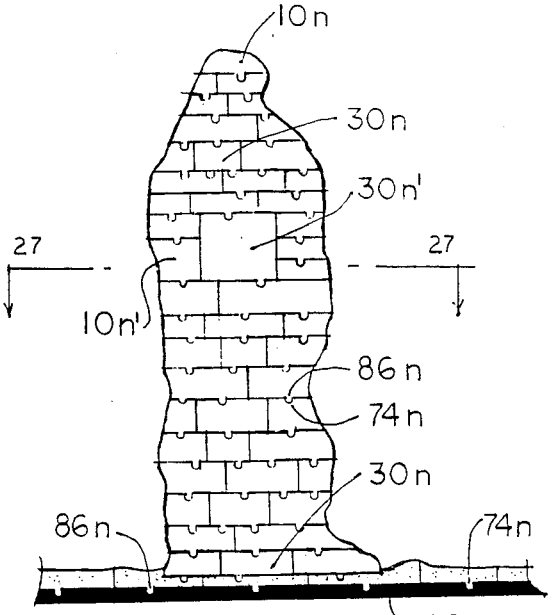
Figure 27:
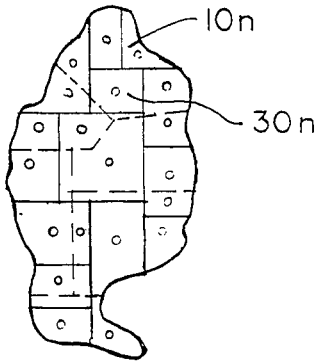
Figure 28:
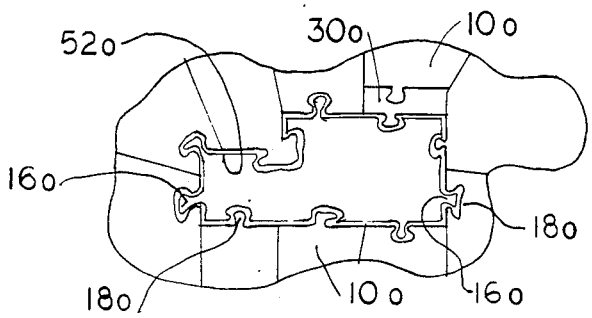
Figure 29:
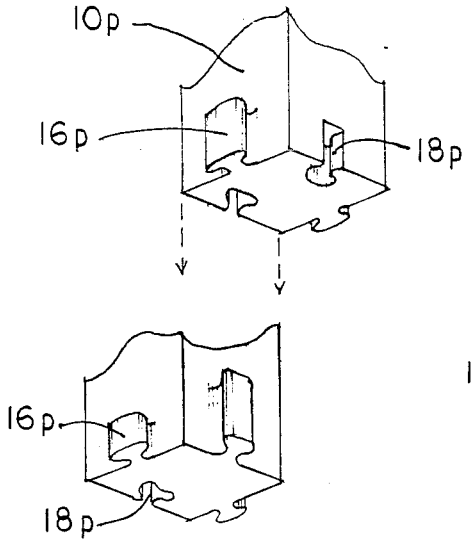
Figure 30:
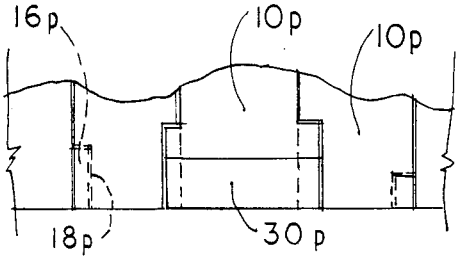

FIG. 15*a* is a cross-sectional view thereof taken generally about on line 15*a*—15*a* in FIG. 14;

FIGS. 16 and 16*a* are similar to FIGS. 15 and 15*a*, respectively, but illustrate an alternative form of construction;

FIG. 17 is an exploded fragmentary perspective view illustrating an interlocking engagement between vertically superposed puzzle pieces;

FIG. 18 is a series of fragmentary perspective views of different bases for the puzzle hereof illustrating a number of varying individual captive means for the puzzle pieces;

FIGS. 19, 19*a*, 20 and 20*a* are fragmentary enlarged sectional views through two of the various base configurations illustrated in FIG. 18 illustrating the relationship between the puzzle pieces or filler pieces and the underlying bases;

FIGS. 21*a*, 21*b*, 21*c* and 21*d* are fragmentary perspective views illustrating the undersides of various puzzle and filler pieces illustrating a variety of captive means for cooperating with the base or other underlying filler pieces;

FIG. 22 is a perspective view of a base having individual captive means, together with raised or tiered sections of another form of the present invention;

FIG. 23 is an enlarged fragmentary cross-sectional view of a base similar to that illustrated in FIG. 22 illustrating the puzzle and filler pieces disposed thereon but disclosing a different captive means;

FIG. 24 is a fragmentary cross-sectional view of a base and puzzle and filler pieces constructed in accordance with a further form of the present invention;

FIG. 25 is a view similar to FIG. 24 illustrating a still further form of the present invention;

FIG. 26 is a fragmentary cross-sectional view of ,an assembled puzzle constructed in accordance with a still further form of the present invention;

FIG. 27 is a cross-sectional view thereof taken generally about on line 27—27 in FIG. 26;

FIG. 28 is a view similar to FIGS. 15*a* and 16*a* illustrating another form of connection between a raised section and the puzzle or filler pieces;

.FIG. 29 is a fragmentary perspective view of a pair of puzzle pieces illustrating a further form of connection therebetween;

FIG. 30 is a cross-sectional view similar to

Figure 6:
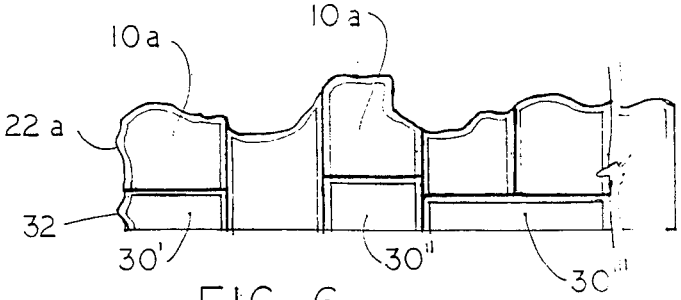
Figure 31:
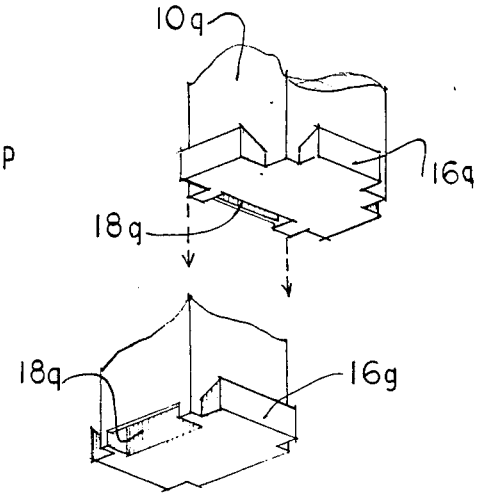
Figure 32:
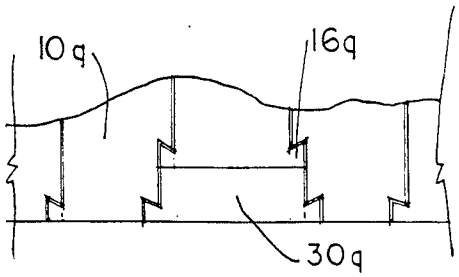

FIGS. 6 and 6*s* illustrating the connection between the puzzle pieces of FIG. 29 in final assembly, together with an underlying filler piece;

FIG. 31 is a view similar to FIG. 29 illustrating a further form of connection between the puzzle pieces; and FIG. 32 is a view similar to FIG. 30 illustrating the connection between the puzzle pieces of FIG. 31 in final assembly, together with a filler piece similarly connected to adjacent puzzle pieces.

DETAILED DESCRIPTION OF THE DRAWING FIGURES

Reference will now be made in detail to the present preferred embodiments of the invention, examples of which are illustrated in the accompanying drawings.

Figure 1:
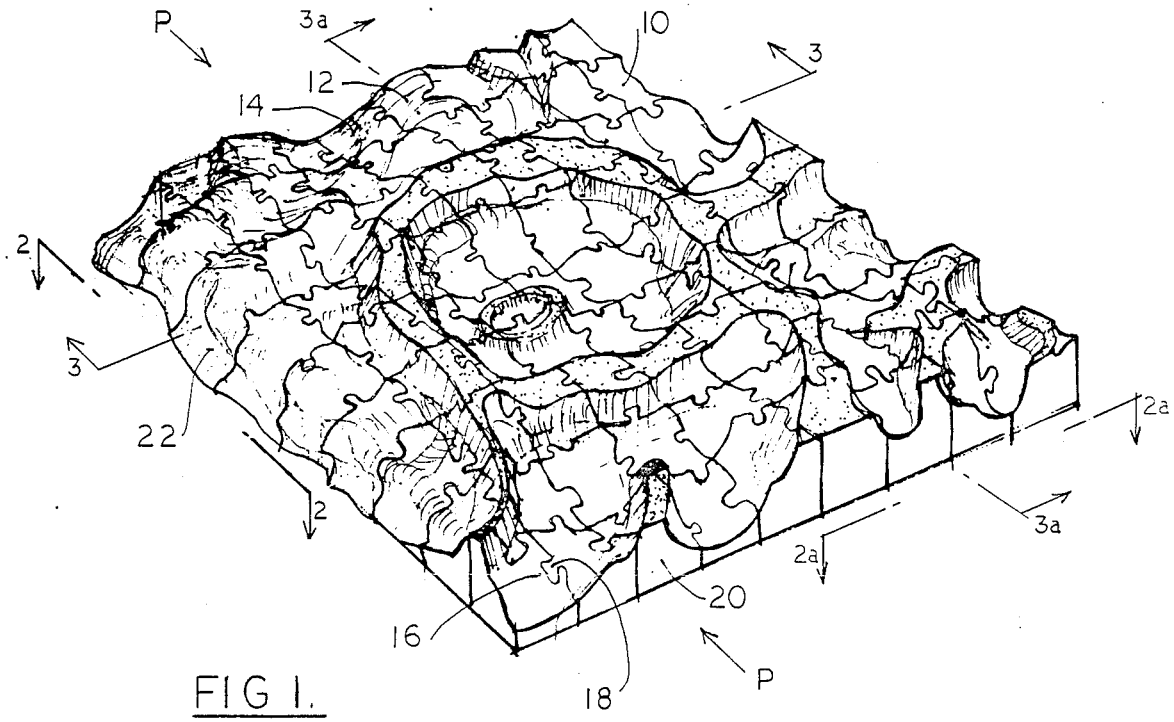

Referring now to FIG. 1, there is illustrated an assembled puzzle, generally designated P, which comprises a plurality of interlocking puzzle segments or pieces 10 which, when assembled on a tabular surface, for example a table top, not shown, form a three-dimensional sculpted surface on its upper surface 12. Preferably, each puzzle piece is formed of a shaped block or shell having discrete surfaces, at least one of which is in a three-dimensional sculpted form, as illustrated at 14. By sculpted is meant broadly a three-dimensional representation which includes, but is not limited to, works of art.

Thus, when the puzzle pieces 10 lie in appropriate assembled relation as illustrated, the sculpted surfaces of adjacent puzzle pieces form the continuous contour of an overall three-dimensional representation, it being appreciated that by the word "continuous" is meant a continuity of the pictorial or topographical representation which may not necessarily constitute a smooth continuity of one sculpted surface relative to the other inasmuch as those surfaces could be stepped or otherwise not lie at like elevations in accordance with the depicted sculpted surface. The term "abutting" is used herein to indicate both physical contact between adjacent pieces, whether they be filler pieces or puzzle pieces or elevated portions of the base, as well as non-physical contact between such adjacent pieces where spacing between such adjacent pieces occurs, for example, by the removal of material in the course of manufacturing, in both cases the conformal relation between such adjacent pieces being maintained at least at the sculpted surface of the assembled puzzle.

Figure 3:
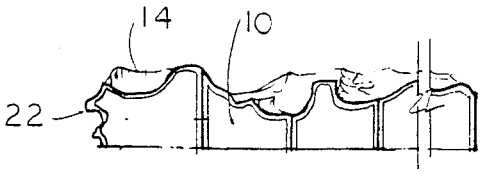
Figure 2A:
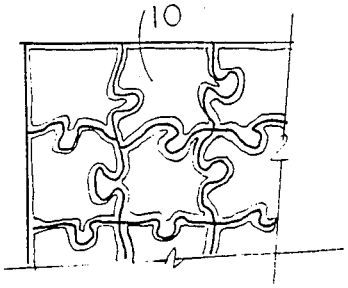
Figure 3A:
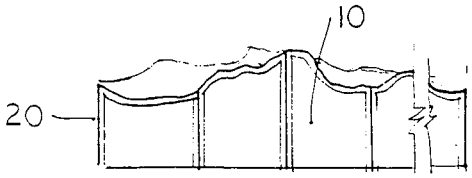

In the form of the present invention illustrated in FIG. 1, the individual puzzle pieces 10 have side surfaces which interlock with abutting side surfaces of adjacent pieces with a conventional tongue-and-groove interlocking arrangement 16 and 18, respectively. It will be appreciated from a review of FIG. 1 that, for most of the puzzle pieces, the sculpted surface 14 is the uppermost surface and that the side surfaces lie in abutting relation with adjacent side surfaces of adjacent puzzle pieces. The edge of the puzzle may take the form of straight vertical side edges, illustrated at 20 in FIGS. 1 and 3*a*, or the side edges which are more or less in vertical relationship with the tabular surface on which the puzzle is erected, may likewise be sculpted as indicated at 22 in FIGS. 1 and 3. It is to be understood that the assembled puzzle shown in FIG. 1 depicts a cratered moonscape and is meant to be exemplary only of any one of a great variety of sculpted three-dimensional surfaces taken from nature or representing man-made objects or any intelligible three-dimensional representation or form of any kind as may be sculpturally adaptable to such a puzzle. By intelligible three-dimensional representation is meant that the puzzle pieces, when assembled, form a single or sole comprehensible shape or configuration as distinguished from shapes or configurations which are non-comprehensible or puzzles in which the pieces may be variously assemblied to form not a single but a plurality of comprehensible shapes or forms.

As best illustrated in FIGS. 2, 2*a*, 3 and 3*a*, the puzzle pieces may be formed of hollow shells, for example, of molded plastic material. Alternatively, the puzzle pieces may be formed of solid materials and, in either event, may be made of wood, plastic, cast metal, cast plaster, cast stone, hardboard or papier-mache. They may be molded, cast and cut or otherwise formed as desired. The sculpted surface or surfaces which are exposed to view may contain a pictorial representation applied in the forming process by applying a surface sheet. Alternatively, a pictorial representation may be applied to the puzzle pieces in their assembled form or in unassembled form.

Figure 4:
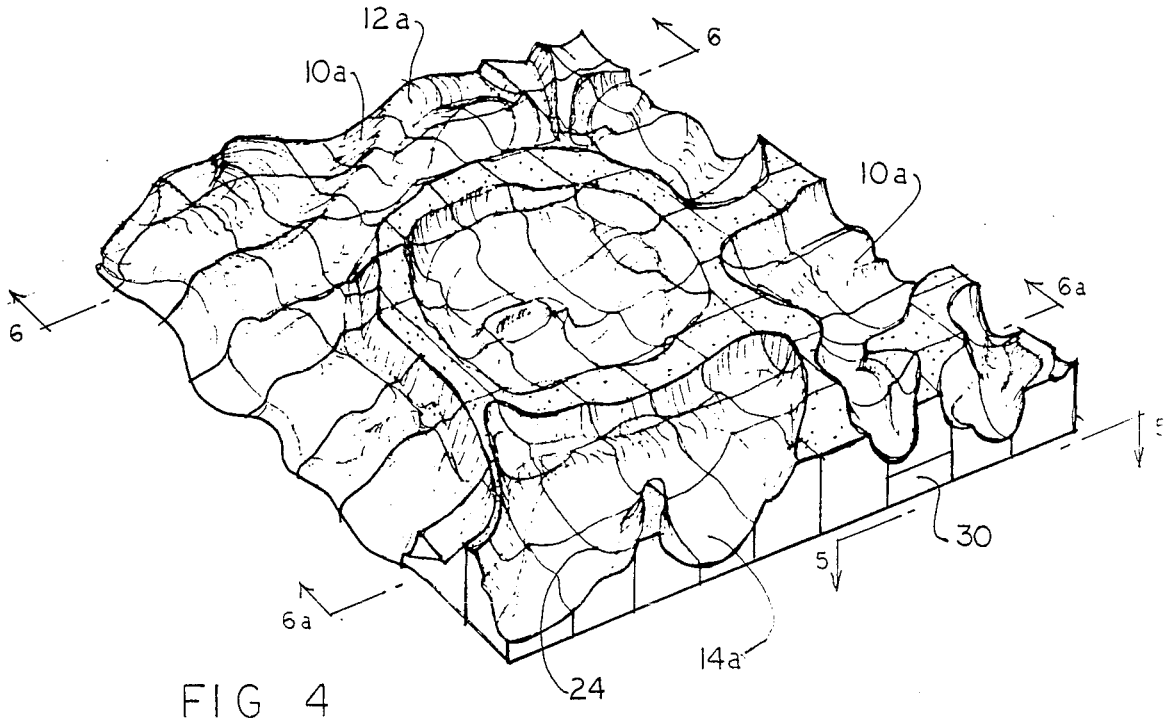

Turning now to FIG. 4, wherein like parts as in FIG. 1 are denoted by like reference numerals followed by the suffix "a", there is illustrated an assembled puzzle similar to the puzzle of FIG. 1 wherein the puzzle pieces 10*a* have their abutting and conformal surfaces in non-interlocking relation one to the other whereby, when the puzzle pieces are assembled and abutted one against the other absent a retaining means to be discussed, the pieces are freely laterally movable away from one another.

Figure 5:
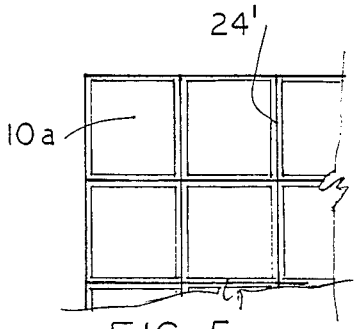
Figure 5A:
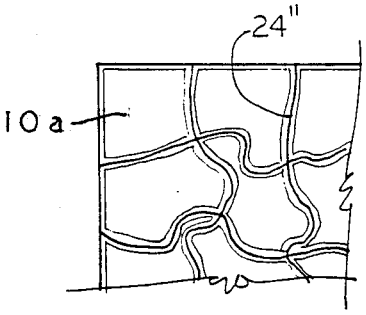

As best illustrated in FIGS. 5 and 5*a*, the abutting non-interlocking side surfaces are designated 24' and 24'', respectively. In FIG. 5, the surfaces 24' are linear whereas, as illustrated in FIG. 5*a*, such surfaces 24'' may be of a curvilinear configuration. In either case, it will be appreciated that the abutting surfaces are conformal one with the other. Thus, the absence of interlocking mechanisms along the abutting conformal side edges increases the complexity of the puzzle, by omitting any clues as to the proper relationship between and among the puzzle pieces for their assembly into the final puzzle form illustrated in FIG. 4. It will be appreciate that the abutting surfaces 24'' illustrated in FIG. 5*a* butt in a sinuous, curvilinear or geometric pattern and that a wide variety of three-dimensional patterns of abutting relationships may be provided. Additionally, the abutting surfaces of adjacent puzzle pieces in both this embodiment and in the preceding embodiment may be non-vertical relative to the tabular surface on which the puzzle is assembled.

Referring now to the embodiment hereof illustrated in FIG. 6, to further increase the complexity of the puzzle, the puzzle pieces 10 may have one or more underlying filler pieces 30 of different shapes and configurations. For example, the filler piece designated 30', adjacent the margin of the puzzle, may have a contoured outer surface 32 which, when it underlies superposed puzzle piece 10*a*, forms with the contoured side surface 22*a* of puzzle piece 10*a* a continuous side edge portion of the three-dimensional representation. The filler piece designated 30'' may underlie a puzzle piece 10*a* intermediate the edges of the puzzle and may have a different elevation than other filler pieces, a different width or length, and may be provided with linear or non-linear three-dimensional sides for abutting relation with adjacent puzzle pieces 10*a* or adjacent filler pieces having similar conformal sides. Additionally, the filler pieces 30 may have a horizontal outline identical to the horizontal outline of its superposed puzzle piece or it may have a horizontal dimension or shape less than or more than the horizontal dimension or shape of an overlying puzzle piece 10*a*, as at 30'''. Further, superposed filler pieces may be used as desired and their abutting and conformal surfaces may be linear, curvilinear or three-dimensional, as desired.

It will be appreciated that the puzzle pieces and filler pieces illustrated in FIG. 6 may have interlocking arrangements, such as tongues and grooves, along their abutting surfaces similarly as described and illustrated with respect to Figures 1–3*a*.

Figure 2:
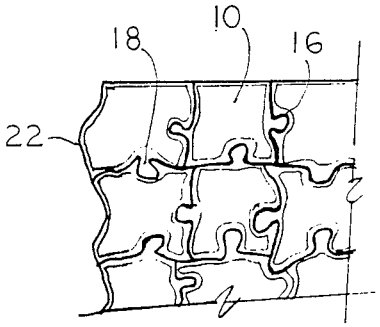
Figure 6A:
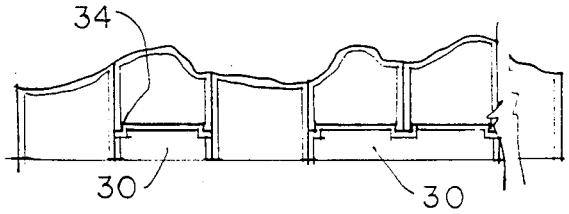

Referring now to FIG. 6*a*, there is provided means for vertically interlocking the puzzle and filler pieces 30 against lateral movement relative to one another. In this form, the margins of the filler pieces about one or more edges may be indented or recessed at 34 such that the edges of the superposed puzzle piece or filler piece as applicable may be nested into the indentations 34 to prevent lateral movement of the superposed piece relative to the underlying piece. It will be appreciated that in an appropriate system of overlapping, the puzzle pieces may be held together by such vertical interlocking configurations without the necessity of interlocking the adjacent sides of the puzzle pieces 10, for example, as illustrated in FIG. 2. This will be readily apparent when it is also realized that the filler pieces, as illustrated in FIG. 6, may extend beyond a single superposed puzzle piece whereby two or more of the superposed puzzle pieces may be disposed on a single filler piece or multiple filler pieces.

Figure 7:
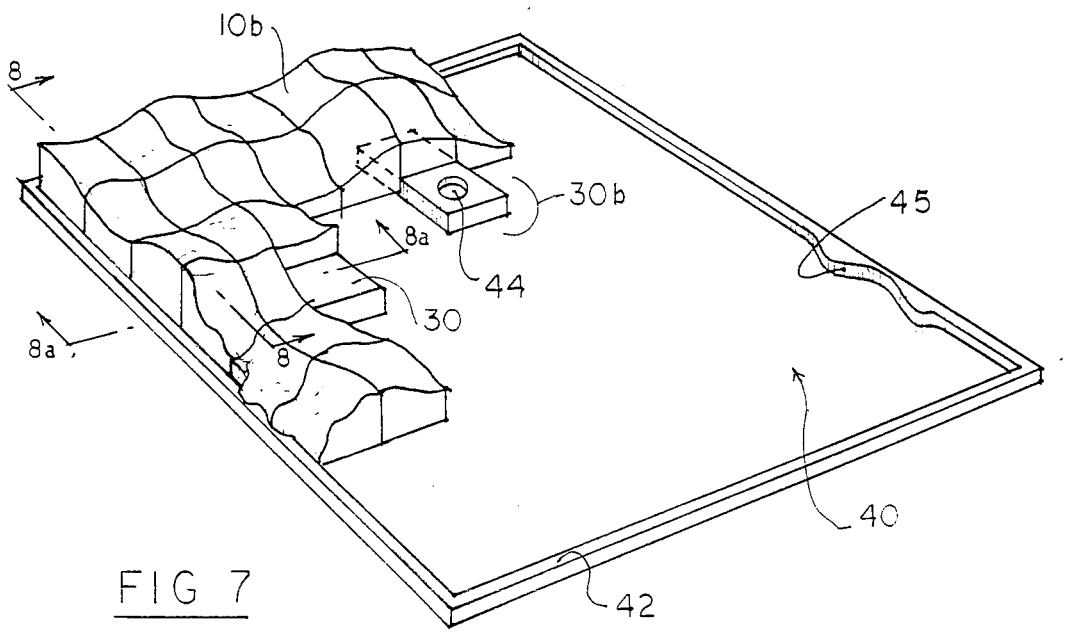
Figure 8:
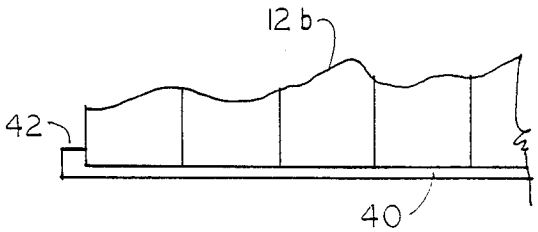

FIG. 7 illustrates a partially assembled puzzle which comprises a base member, generally designated 40, upon which puzzle pieces 10*b* are assembled. The puzzle pieces may be in the configuration described previously with respect to FIG. 4, i.e., having non-interlocking side edges. The puzzle pieces 10b are confined or contained on the base 40 in their assembled form by raised edges 42. In FIG. 8, the side edges of the outermost puzzle pieces are illustrated as extending linearly in a vertical direction, whereas in FIG. 9, the side edges of the outermost puzzle pieces are sculpted down to and overlap the upper edge of edge containment 42. It will be appreciated that the inner vertical surface 45 of the edge containment may be sculpted to conform with the sculpted side edges of the outermost puzzle pieces.

Figure 8A:
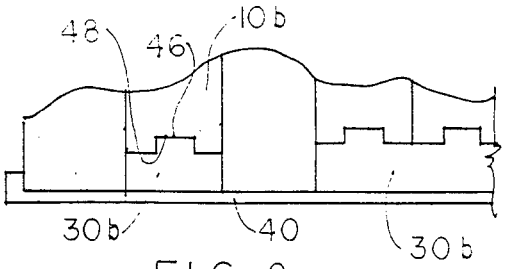

Looking at FIGS. 7 and 8*a*, filler pieces 30*b*, constructed similarly as described in connection with FIG. 6, may be utilized. In this form of filler piece, a vertical interlock may likewise be provided similarly as illustrated in FIG. 6*a*. However, in this form, a central recess 44, as illustrated in FIG. 7, may be provided to receive a projecting boss on the overlying puzzle piece 10b. Alternatively, as illustrated in FIG. 8*a*, the filler piece 30*b* may have a projecting boss 46 for reception in a recess 48 formed in the undersurface of the overlying puzzle piece 10b. As illustrated in FIG. 8*a*, the filler pieces 30*b* may correspond laterally to the overlying puzzle pieces or may extend beyond the overlying puzzle pieces whereby two or more puzzle pieces may be vertically interlocked to a single or multiple filler piece.

Figure 9:
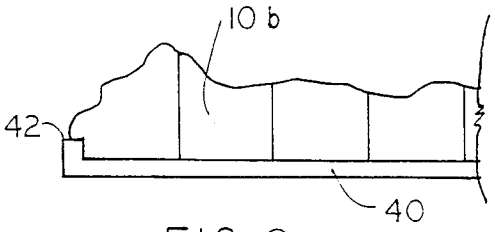
Figure 9A:
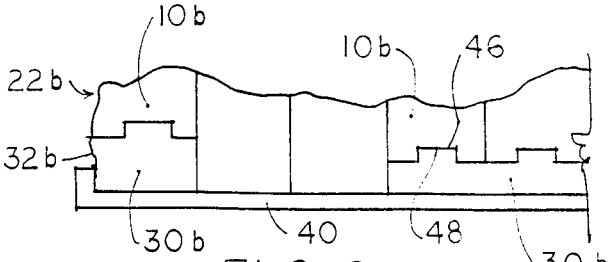

In FIGS. 7, 8, 8*a*, 9 and 9*a*, the puzzle pieces 10 are formed of a solid material rather than hollow as in the previous embodiments. The pieces are edge contained. In FIG. 9, the sculpted surface extends down to the edge 42, whereas in FIG. 9*a*, the side of the puzzle above edge 42 is sculpted as at 32*b* with respect to filler piece 30*b* and 22*b* with respect to puzzle piece 10b.

Figure 10:
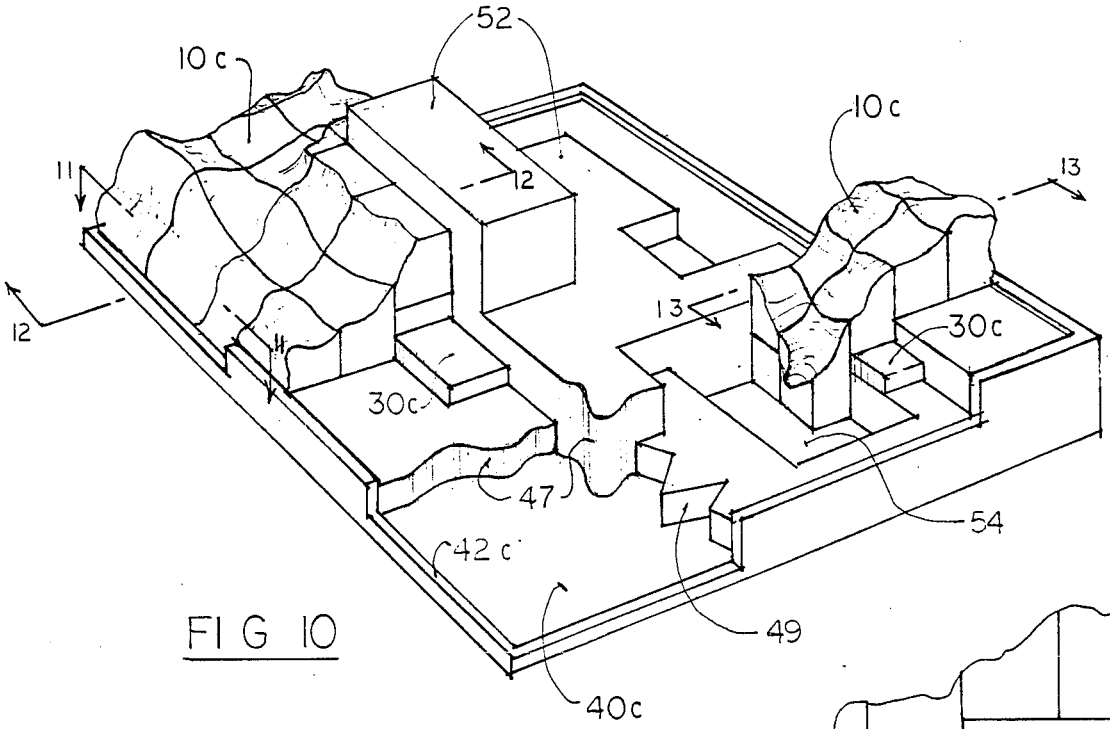
FIG. 10 is a perspective view of a partially assembled puzzle constructed in accordance with a further embodiment of the present invention illustrating puzzle pieces, filler pieces and a base having raised or tiered sections and a containing
Figure 11:
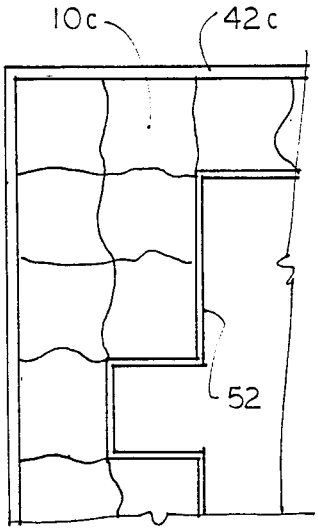
FIG. 11 is a cross-sectional view of a portion of the partially completed puzzle of FIG. 10 taken about line 11—11.

Referring now to the embodiment hereof illustrated in FIG. 10, there is provided a base member 40*c* which has raised and depressed sections 52 and 54, respectively, upon which puzzle pieces 10*c* are assembled. As before, the puzzle pieces may be contained by raised edges 42*c*. The raised or depressed sections 52 and 54, respectively, may receive puzzle pieces 10*c* or filler pieces 30*c*. The puzzle pieces 10*c* or filler pieces 30*c* may be provided with vertical interlocking arrangements similarly as illustrated in FIGS. 6*a*, 7 and 8*a* whereby the puzzle pieces, filler pieces and raised and depressed sections 52 and 54 may be interlocked vertically to constrain the pieces from lateral movement. As illustrated in FIG. 11, the sides of the abutting puzzle pieces 10*c* are preferably non-interlocking, similarly as illustrated in Figure 4, but may be interlocking as illustrated in Figure 1. It will be appreciated that the conformal side surfaces of the raised and depressed sections may be curvilinear or geometric as at 47 and 49, respectively. The horizontal surfaces thereof may likewise be curvilinear or geometric for conformance with similar bottom surfaces on the filler or puzzle pieces.

Figure 12:
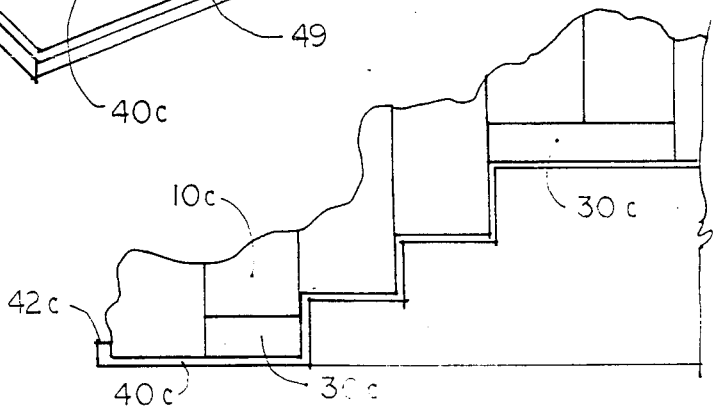
FIG. 12 is a cross-sectional view of the puzzle illustrated in FIG. 10 taken generally about on line 12—12 in FIG. 10.
Figure 13:
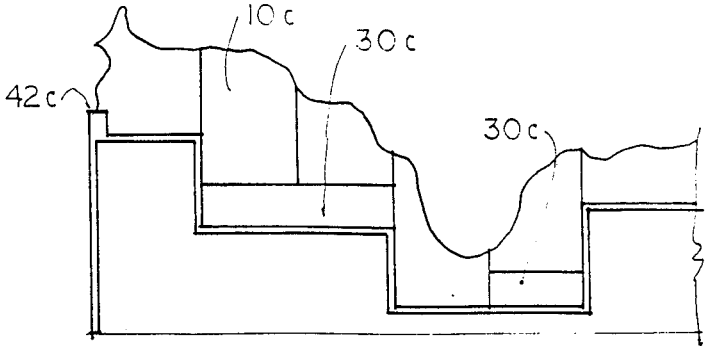
FIG. 13 is a view similar to FIG. 12 illustrating an alternative form of edge configuration and taken generally about on line 13—13 in FIG. 10.

FIG. 12 is a cross-section of the partially assembled puzzle illustrated in FIG. 10 illustrating the raised or tiered sections with overlying puzzle pieces and filler pieces, the tiered sections cascading downwardly toward the edge 42*c*. In contrast, FIG. 13 illustrates a puzzle constructed as described with respect to FIG. 10 with the tiered base cascading upwardly toward the edge 42*c*. It will be understood that the tiered sections of the base may be arranged in any number of combinations whereby the relationships indicated in FIGS. 12 and 13 may be combined into a multi-level base having a multiplicity of elevational variations. It is also to be understood that the variations of the relationship of the puzzle pieces and filler pieces noted in connection with FIGS. 5, 5*a*, 6 and 6*a*, 7 and 8*a* are applicable to the embodiment illustrated in FIGS. 10 through 13. It will be appreciated that the raised or depressed sections of the base may have a tongue and groove interlocking arrangement with puzzle and filler pieces as illustrated in FIG. 28.

In FIG. 14, there is provided a base 40*d* having a raised edge 42*d*, together with a multi-tiered or elevated portion 52*d* arranged such that the puzzle pieces in final assembly are disposed about the tiered portion 52*d* to produce a three-dimensional sculptured form in the full round. It will be appreciated from a review of FIG. 14 that the puzzle pieces 10*d*, as they are disposed one on top of the other as described below, have their sculpted surfaces, depending on their position in the puzzle, either on the top surface or a side surface or, in certain instances, both surfaces. As illustrated in FIG. 15, the puzzle pieces 10*d*, having sculpted surfaces 12*d* along their sides or top, or both, may be simply superposed one over the other without interlocking and may also be provided with filler pieces 30*d*. Instead of underlying the puzzle pieces, filler pieces 30*d* lie intermediate tiered section 52*d* and puzzle pieces 10*d*. Also as illustrated in FIG. 15, the upper surface of the tiered section 52*d* may be provided with a sculpted surface 60 which is surrounded by adjacent puzzle pieces 10*d*, the sculpted surface 60 forming with the sculpted surfaces of the surrounding puzzle pieces a portion of the continuous three-dimensional representation.

Preferably, the puzzle pieces of the embodiment hereof illustrated in FIG. 14 are interlocked one to the other. For example, as illustrated in Figure 15*a*, the puzzle pieces 10*e* may have interlocking projections and recesses similarly as the embodiment hereof illustrated in FIG. 1. It will be appreciated that with such interlocking adjacent side surfaces, the configuration is such that the puzzle pieces are locked one to the other about the raised central portion 52*d* in their fixed final assembled form.

As an alternative to the interlocking relationship illustrated in FIG. 15*a*, the puzzle pieces may be vertically interlocked, as illustrated in FIGS. 16, 16*a* and 17. In this form, the overlying puzzle pieces or filler pieces, as applicable, have projecting pins 53 for reception in recesses 55 formed in the upper surfaces of the underlying puzzle pieces 10*d* or filler pieces 30*d*. It will be appreciated that the overlying puzzle pieces may span one or more of the underlying puzzle pieces or filler pieces, or a combination of puzzle and filler pieces. Alternatively, the underlying puzzle pieces and filler pieces may have pins in their upper surfaces projecting for reception into recesses formed in the undersurfaces of the overlying puzzle pieces and filler pieces or any other interlocking device. In this manner, it will be appreciated that the puzzle pieces in final assembly are interlocked one with the other about the central tiered portion 52*d* . With certain forms of interlocking devices on the puzzle and filler pieces, the base edge 40*d* may be omitted.

FIG. 17 illustrates a manner of interlocking the superposed pieces wherein the superposed pieces may span two or more of the underlying pieces, whether they be puzzle pieces or filler pieces, with the interlocking pins and recesses formed such that adjacent pieces at each level are interlocked with one or more adjacent pieces of the next superposed or underlying level. Thus, the puzzle pieces of each layer overlap the juncture of the puzzle or filler pieces of the layer next below and above and captively interlock with the puzzle or filler pieces on such layers so that, in surrounding cooperation with the raised section 52*d* of the base, the puzzle is held fixedly in its final assembled form. It will also be appreciated that any one or more portions of the base can be exposed to view, i.e., have a sculpted surface, to form a portion of the three-dimensional representation when the puzzle is finally assembled.

With the various forms of interlocking relationships between the puzzle pieces and filler pieces illustrated in FIGS. 15*a*, 16, 16*a* and 17 and FIG. 28 to be described, the base or the edge confinement or both need not be used. It will be appreciated that such interlocking relationships lock the various pieces about the raised section(s) and those pieces and the raised section(s) may be assembled on a tabular surface without a base.

Turning now to FIG. 18, there is illustrated a plurality of captive means for locking individual puzzle pieces or filler pieces against lateral movement. For example, the captive means on base 40*f* may comprise a grid 70 exposed on the flat base and defining squares or rectangles in the base. The lower margins of the puzzle pieces or filler pieces may be recessed at 72 such that the pieces may be interlocked with the grid against lateral movement. In an alternate form, the bases 40*g* and 40*h* may be provided with recesses 74 or upwardly projecting pins 76, respectively, for cooperation with downwardly projecting pins or recesses formed on the underside of the puzzle or filler pieces, as illustrated in FIGS. 21*c* and 21*d*, respectively. In a further alternate form, base 40*i* may have a grid formed of upwardly projecting square or rectangular portions 77 for reception in the open lower surface of the overlying puzzle or filler pieces. Also, base 40*j* may have a grid 78 formed of unequal-sized rectangles for cooperation with grooves formed in the lower faces of the superposed puzzle or filler pieces or with reduced margins for receiving within the confines of the grid members the reduced lower portion of the puzzle or filler pieces. Fundamentally, the captive means on the base may be raised or indented or of any size or configuration, provided the cooperation between the base and the overlying puzzle or filler pieces provide for vertical interlocking, i.e., prevent lateral movement of such pieces relative to one another and the base.

Figure 19:
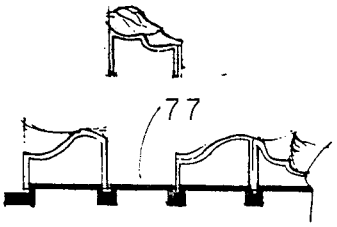

FIG. 19 illustrates a base having raised sections 77 with grooves defined therebetween for receiving the lower edges of the puzzle or filler pieces.

Figure 19A:
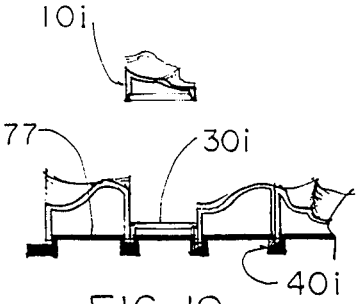

FIG. 19*a* is a view similar to FIG. 19 but shows a filler piece 30*i* mounted on the base with the upper surface of the filler piece 30*i* having a like configuration as the base to receive the lower edges of the puzzle piece 10*i*. Thus, puzzle piece 10 *i* may vertically interlock with the underlying filler piece 30*i* or may interlock directly with the base 40*i*.

Figure 20:
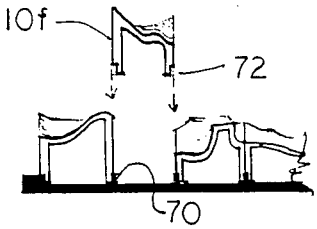
Figure 20A:
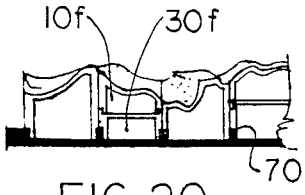

FIG. 20 illustrates a base having a grid 70 for receiving puzzle pieces 10*f* which have recessed edges 72. Thus, the puzzle piece 10*f* is received within the grid pattern with its recessed edge vertically interlocking the puzzle piece against lateral movement. FIG. 20*a* is similar to FIG. 20 and illustrates the use of a filler piece between the base and the overlying puzzle piece.

Figure 21A:
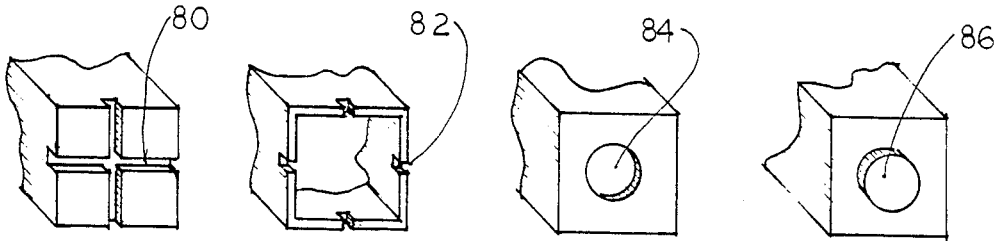

FIGS. 21*a* through 21*d* are perspective views of the underside of puzzle segments illustrating just some of the many forms of individually captive means possible. FIGS. 21*a* is a view of a solid puzzle piece showing two crossed slots 80 which would fit astride the crossed raised strips 90 of a grid on the base 40*k* shown in FIG. 23. FIG. 21*b* is a view of a hollow puzzle segment having slots 82 on the underside of its side edges which would fit astride raised crossed raised strips in the same manner as the puzzle piece shown in FIG. 21*a*. FIG. 21*c* indicates a puzzle piece with a round recess 84 which would captively engage a round peg, for example the peg 76 on the base 40*h* as shown in FIG. 18. Figure 21*d* shows a round peg 86 on the bottom of a puzzle piece which would captively engage a round recess, for example recess 74, on the base 40*g* as shown in FIG. 18. Many other forms of individually captive means are possible, though not shown.

FIG. 22 shows a base 40*k*' with individually captive means, such as a grid 70*k*' similar to the grid 70 on base 40 of FIG. 18. In this form, sections 88 of the base are raised or tiered.

FIG. 23 illustrates a base 40*k* with raised sections 88*k* having filler pieces 30*k* and puzzle pieces 10*k* having grid 90 for reception in slots 80 of puzzle pieces of the type illustrated in Figure 21*a* or in similar slots of filler pieces. It will be understood that the raised sections 88*k* of the base may be arranged in ascending order from the edge of base 40*k* as shown in FIG. 23 or in descending order similar to that shown in FIG. 13. It will be understood that raised sections in this form are not necessary and that a flat base may be used. Note also that the edge containment is not necessary in this form and that the puzzle pieces and filler pieces need not be conformed in a vertical direction but multiple filler pieces may underlie one or more puzzle pieces and vice-versa. The pieces may also overlap laterally, as illustrated in FIG. 17. The grid comprised of strips 90 is arranged similarly as in FIG. 22 but displaced differently relative to the edge.

FIG. 24 illustrates a configuration wherein the assembled puzzle pieces 101 do not cover the entire base 401 but leave one or more portions 92 of base 401 exposed to view beyond the assembled edge of puzzle pieces 101. The final form of the assembled puzzle may also have inner portions 94 of base 401 exposed to view and surrounded by puzzle pieces 101. It is to be further understood that those portions of the base 92 and 94 left exposed to view beyond the edges of the assembled puzzle segments may or may not have a three-dimensional sculpted surface. Filler pieces 301 may also be used in this embodiment.

FIG. 25 illustrates puzzle pieces 10*m* which have a three-dimensional sculptured bottom surface 96 which cooperatively engages a mutually three-dimensionally sculpted or conformal upper surface 98 of base 40*m*. Base 40*m* and puzzle pieces 10*m* in FIG. 25 may or may not have mutually captive means such as 76*m* and 84*m* and may or may not have containing edges 42*m*.

FIG. 26 is a cross-section of an assembled puzzle having a base 40*n* having individual captive means, in this example shown as recessed peg holes 74*n*. Holes 74*n* captively receive pins 86*n* of puzzle pieces 10 *n* and filler segments 30*n* having vertically cooperatively interlocking devices which, as they are assembled, in a vertically layered sequence, overlap and interlock in the manner indicated in FIG. 17 to fixedly retain the assembled puzzle in its final assembled form. It is to be understood that this embodiment may or may not employ a containing edge on base 40*n* and may be rendered with no base at all in an embodiment wherein there is a minimum of two layers of overlapping and vertically cooperatively interlocking puzzle pieces 10*n* and filler pieces 30*n*. Some filler segments 30*n* ' and puzzle segments 10*n*' may have an overall height larger than one typical layer of puzzle or filler segments.

FIG. 27 indicates puzzle pieces 10*n* and filler pieces 30*n* having vertically cooperative interlocking devices, for example similar to pins 53 and recesses 55 of FIG. 17 which overlap puzzle pieces 10*n* and filler pieces 30*n* in the layer next below, indicated by dashed lines in this FIG. 27.

Referring now to FIG. 28, a tiered section or central pylon 52*o*, of a form of the invention generally depicted in FIG. 14, may have tongues 16*o* or grooves 18*o*, whereby a tongue-and-groove interlocking relation may be provided between the tiered section 52*o* and the adjacent puzzle pieces 10*o* or filler pieces 30*o*. Thus, the superposed puzzle pieces and filler pieces are interlocked with a central pylon or tiered section 52*o* to form, upon final assembly, a completed puzzle, for example, similar to the puzzle illustrated in FIG. 14.

Additional forms of interconnection between the adjacent puzzle pieces and filler pieces are illustrated in FIGS. 29 through 32. In FIG. 29, the puzzle pieces 10*p* are provided with tongues 16*p* and grooves 18*p*, which extend from their bases upwardly toward but terminate short of their sculpted surfaces. Thus, tongue-and-groove connections can be made between laterally adjacent puzzle pieces by vertical sliding movement of the pieces relative to one another. It will be appreciated that tongues 16*p* and grooves 18*p* extend only part-way up from the underside of puzzle pieces 10*p* such that in final interlocking assembly, the interconnections are hidden from view. In final assembly, therefore, the puzzle may appear as in FIG. 4 hereof with the side edges sculpted down to the undersides of the puzzle pieces or with linear side edges, or both, as desired. Note that in this form edge containment of the puzzle pieces or interlocking of the pieces with a base is not necessary.

Such final assembly is illustrated in FIG. 30. There, a filler piece 30*p* is illustrated underlying one of the puzzle pieces 10*p*. The filler piece may have tongue-and-groove connections which extend the full height of such filler pieces. If the filler pieces lie intermediate the edges of the puzzle, tongue-and-groove connections need not be provided and the filler pieces may simply follow the contour of the overlying puzzle piece or, as previously explained, the filler pieces 30*p* may extend to a greater or lesser lateral extent than the overlying puzzle pieces.

Referring now to FIG. 31, the interconnections between the adjacent puzzle pieces 10 *q* may be provided by tongues 16*q* in the shape of half-dovetails. The pieces 10 *q* may also be provided with grooves 18*q* in the form of recesses formed in the underside of the puzzle pieces to complementarily receive the projecting dovetail tongues 16*q* in final assembly. Such assembly is illustrated in FIG. 32 and it will be appreciated that the interconnections are hidden from view. Additionally, filler pieces 30*q* may be provided with similar tongue-and-groove connections or, as described above in connection with FIG. 30, may have other types of interconnections or none at all, depending upon their location within the puzzle, as previously explained.

It will be apparent to those skilled in the art that the puzzle parts may be made of wood, plastic, cast metal, cast plaster or cast stone, papier-mache or other materials and may have a design imprinted on its exposed surfaces or may have a surface sheet of imprinted design applied to its exposed surfaces. The parts of the puzzle may be individually molded pieces, they may be assembled of separate pieces fitted and adhered together, or they may be cut from a precast larger piece. The pieces may be solid or hollow.

It will be appreciated that the puzzles herein described are very specific and that all or many of the specifically described aspects of the puzzles may be combined in various forms without departing from the spirit of the invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A three-dimensional puzzle for forming solely a single intelligible three-dimensional representation, comprising:

a plurality of puzzle pieces identical both in geometric form and size in plan and having top, bottom, and side surfaces, the top surface of each puzzle piece being in three-dimensional sculpted form and which sculpted surfaces in the aggregate and upon assembly of the puzzle pieces into predetermined positions form solely a predetermined single intelligible three-dimensional representation, with any other assembly of said pieces forming a non-intelligible three-dimensional configuration;

the side surface of said puzzle pieces extending linearly in lateral directions and being free of any means, including interlocks between said side surfaces, which would indicate the location or orientation of any puzzle piece in the final assembly of the puzzle, each side surface of each puzzle piece adjacent another puzzle piece abutting and lying in conformal relation with a side surface of said adjacent puzzle piece without any interlock therebetween upon assembly of said puzzle pieces, the bottom surface of each said puzzle piece having an interlocking part, said bottom surface and said interlocking part of each puzzle piece being identical in shape to the shapes of the bottom surface and interlocking part of each other puzzle piece, respectively, and being free of any means which would indicate the location or orientation of any puzzle piece in the final assembly of the puzzle; and a base underlying the puzzle pieces and carrying a plurality of elements cooperable with said interlocking parts to retain said pieces in said predetermined assembly with said side surfaces abutting one another, said base being free of any means, including said elements, which would indicate the location or orientation of any puzzle piece in the final assembly of the puzzle, said assembled puzzle pieces having a peripheral margin, at least certain ones of said puzzle pieces defining portions of said peripheral margin having a sculpted side surface.

2. A puzzle according to claim 1 wherein said base includes a peripheral edge, at least one puzzle piece having a side surface thereof overlying a portion of said peripheral edge.

3. A three-dimensional puzzle for forming solely a single intelligible three-dimensional representation, comprising:

a plurality of puzzle pieces identical both in geometric form and size in plan and having top, bottom, and side surfaces, the top surface of each puzzle piece being in three-dimensional sculpted form and which sculpted surfaces in the aggregate and upon assembly of the puzzle pieces into predetermined positions form solely a predetermined single intelligible three-dimensional representation, with any other assembly of said pieces forming a non-intelligible three-dimensional configuration;

the side surfaces of said puzzle pieces extending linearly in lateral directions and being free of any means, including interlocks between said side surfaces, which would indicate the location or orientation of any puzzle piece in the final assembly of the puzzle, each side surface of each puzzle piece adjacent another puzzle piece abutting any lying in conformal relation with a side surface of said adjacent puzzle piece without any interlock therebetween upon assembly of said puzzle pieces, the bottom surface of each said puzzle piece having an interlocking part, said bottom surface and said interlocking part of each puzzle piece being identical in shape to the shapes of the bottom surface and interlocking part of each other puzzle piece, respectively, and being free of any means which would indicate the location or orientation of any puzzle piece in the final assembly of the puzzle;

at least one filler piece for underlying at least a portion of one of said puzzle pieces for elevating said one puzzle piece to elevate its sculpted surface above the elevation thereof without said filler piece, said elevated puzzle piece having its sculpted surface forming upon assembly with said plurality of puzzle pieces and said filler piece the three-dimensional representation, said filler piece having an upper surface carrying an element cooperable with said interlocking part of said one puzzle piece to retain said one puzzle piece in said predetermined assembly with said side surfaces thereof abutting side surfaces of adjacent puzzle pieces, said filler piece having a bottom surface with an interlocking part; and a base underlying the puzzle piece and carrying a plurality of elements cooperable with said interlocking parts to retain said pieces in said predetermined assembly with said side surfaces abutting one another, said base and said filler piece being free of any means, including said elements and said filler piece interlocking part, which would indicate the location or orientation of any puzzle piece or filler piece in the final assembly of the puzzle.

4. A puzzle according to claim 3 wherein said filler piece and the one puzzle piece have like lateral confines such that the one filler piece may underlie the one puzzle piece without projecting beyond the lateral confines of said one puzzle piece.

5. A puzzle according to claim 3 wherein a lateral dimension of said one filler piece is different than the lateral dimension of said one puzzle piece, whereby one of said filler piece and said one puzzle piece extends laterally beyond the other of said one filler piece and said one puzzle piece.

6. A three-dimensional puzzle for forming solely a single intelligible three-dimensional representation, comprising:

a plurality of puzzle pieces identical in geometric form in plan and having top, bottom, and side surfaces, the top surface of each puzzle piece being in three-dimensional sculpted form and which sculpted surfaces in the aggregate and upon assembly of the puzzle pieces into predetermined positions form solely a predetermined single intelligible three-dimensional representation, with any other assembly of said pieces forming a non-intelligible three-dimensional configuration;

the side surfaces of said puzzle pieces extending linearly in lateral directions and being free of any means, including interlocks between said side surfaces, which would indicate the location and orientation of any puzzle piece in the final assembly of the puzzle, each side surface of each puzzle piece adjacent another puzzle piece abutting and lying in conformal relation with a side surface of said adjacent puzzle piece without any interlock therebetween upon assembly of said puzzle pieces, the bottom surface of each said puzzle piece having an interlocking part, said bottom surface and said interlocking part of each puzzle piece being identical in shape to the shapes of the bottom surface and interlocking part of each other puzzle piece, respectively, and being free of any means which would indicate the location and orientation of any puzzle piece in the final assembly of the puzzle;

a base underlying the puzzle pieces and carrying a plurality of elements cooperable with said interlocking parts to retain said pieces in said predetermined assembly with said side surfaces abutting one another, said base being free of any means, including said elements, which would indicate the location and orientation of any puzzle piece in the final assembly of the puzzle; and at least one filler piece for underlying at least a portion of one of said puzzle pieces for elevating said one puzzle piece to elevate its sculpted surface above the elevation thereof without said filler piece, said elevated puzzle piece having its sculpted surface forming upon assembly with said plurality of puzzle pieces and said filler piece the three-dimensional representation.

7. A puzzle according to claim 6 wherein said filler piece and the one puzzle piece have like lateral confines such that the one filler piece may underlie the one puzzle piece without projecting beyond the lateral confines of said one puzzle piece.

8. A three-dimensional puzzle for forming solely a single intelligible three-dimensional representation, comprising:

a plurality of puzzle pieces identical in geometric form in plan and having top, bottom, and side surfaces, the top surface of each puzzle piece being in three-dimensional sculpted form and which sculpted surfaces in the aggregate and upon assembly of the puzzle pieces into predetermined positions form solely a predetermined single intelligible three-dimensional representation, with any other assembly of said pieces forming a non-intelligible three-dimensional configuration;

the side surfaces of said puzzle pieces extending linearly in lateral directions and being free of any means, including interlocks between said side surfaces, which would indicate the location and orientation of any puzzle piece in the final assembly of the puzzle, each side surface of each puzzle piece adjacent another puzzle piece abutting and lying in conformal relation with a side surface of said adjacent puzzle piece without any interlock therebetween upon assembly of said puzzle pieces, the bottom surface of each said puzzle piece having an interlocking part, said bottom surface and said interlocking part of each puzzle piece being identical in shape to the shapes of the bottom surface and interlocking part of each other puzzle piece, respectively, and being free of any means which would indicate the location and orientation of any puzzle piece in the final assembly of the puzzle; and a base underlying the puzzle pieces and carrying a plurality of elements cooperable with said interlocking parts to retain said pieces in said predetermined assembly with said side surfaces abutting one another, said base being free of any means, including said elements, which would indicate the location and orientation of any puzzle piece in the final assembly of the puzzle, the finally assembled puzzle pieces having a peripheral margin, at least certain ones of said puzzle pieces defining portions of said peripheral margin having a sculpted side surface.

9. A puzzle according to claim 8 wherein said base includes a peripheral edge, at least one puzzle piece having a side surface thereof overlying a portion of said peripheral edge.

10. A three-dimensional puzzle for forming solely a single intelligible three-dimensional representation, comprising:

a plurality of puzzle pieces identical in geometric form in plan and having top, bottom, and side surfaces, the top surface of each puzzle piece being in three-dimensional sculpted form and which sculpted surfaces in the aggregate and upon assembly of the puzzle pieces into predetermined positions form solely a predetermined single intelligible three-dimensional representation, with any other assembly of said pieces forming a non-intelligible three-dimensional configuration;

the side surfaces of said puzzle pieces extending linearly in lateral directions and being free of any means, including interlocks between said side surfaces, which would indicate the location and orientation of any puzzle piece in the final assembly of the puzzle, each side surface of each puzzle piece adjacent another puzzle piece abutting and lying in conformal relation with a side surface of said adjacent puzzle piece without any interlock therebetween upon assembly of said puzzle pieces, the bottom surface of each said puzzle piece having an interlocking part, said bottom surface and said interlocking part of each puzzle piece being identical in shape to the shapes of the bottom surface and interlocking part of each other puzzle piece, respectively, and being free of any means which would indicate the location and orientation of any puzzle piece in the final assembly of the puzzle;

a base underlying the puzzle piece and carrying a plurality of elements cooperable with said interlocking parts to retain said pieces in said predetermined assembly with said side surfaces abutting one another, the interlocking part on each said puzzle piece being cooperable with an element on said base to establish fixed, non-rotational orientation of said puzzle piece upon application thereof on said base, said base being free of any means, including said elements, which would indicate the location and orientation of any puzzle piece in the final assembly of the puzzle; and said base having a surface for receiving said puzzle pieces, at least a portion of said base surface having a three-dimensional configuration and which base surface portion, when the puzzle pieces are assembled to form the puzzle, forms with said assembled pieces part of a continuous three-dimensional puzzle.

11. A puzzle according to claim 3 wherein the side surfaces, bottom surfaces, interlocking parts and said base are free of any means which would indicate both location and orientation of any puzzle piece in the final assembly of the puzzle.

12. A three-dimensional puzzle for forming solely a single intelligible three-dimensional representation, comprising:

a plurality of puzzle pieces identical both in geometric form and size in plan and having top, bottom, and side surfaces, the top surface of each puzzle piece being in three-dimensional sculpted form and which sculpted surfaces in the aggregate and upon assembly of the puzzle pieces into predetermined positions form solely a predetermined single intelligible three-dimensional representation, with any other assembly of said piece forming a non-intelligible three-dimensional configuration;

the side surfaces of said puzzle pieces extending linearly in lateral directions and being free of any means, including interlocks between said side surfaces, which would indicate the location or orientation of any puzzle piece in the final assembly of the puzzle, each side surface of each puzzle piece adjacent another puzzle piece abutting and lying in conformal relation with a side surface of said adjacent puzzle piece without any interlock therebetween upon assembly of said puzzle pieces, the bottom surface of each said puzzle piece having an interlocking part, said bottom surface and said interlocking part of each puzzle piece being identical in shape to the shapes of the bottom surface and interlocking part of each other puzzle piece, respectively, and being free of any means which would indicate the location or orientation of any puzzle piece in the final assembly of the puzzle;

a base underlying the puzzle piece and carrying a plurality of elements cooperable with said interlocking parts to retain said pieces in said predetermined assembly with said side surfaces abutting one another, interlocking part on each said puzzle piece being cooperable with an element on said base to establish fixed, non-rotational orientation of said puzzle piece upon application thereof on said base, said base being free of any means, including said elements, which would indicate the location or orientation of any puzzle piece in the final assembly of the puzzle; and said interlocking part on each said puzzle piece including means defining a slot opening through said bottom surface, each of said base elements including an upstanding rib for reception in said slot upon application of a puzzle piece on said base.

13. A three-dimensional puzzle according to claim 12 wherein each of said puzzle pieces includes discrete side walls having lower edges, said interlocking part including means defining a slot in each of said edges opening through said bottom surface, each of said elements including ribs upstanding from said base for reception in said slots upon application of said puzzle piece on said base.

14. A three-dimensional puzzle according to claim 13 wherein said puzzle piece is hollow.

15. A three-dimensional puzzle according to claim 12 wherein said puzzle piece is formed of solid material.

16. A three-dimensional puzzle for forming solely a single intelligible three-dimensional representation, comprising:

a plurality of puzzle pieces identical in geometric form in plan and having top, bottom, and side surfaces, the top surface of each puzzle piece being in three-dimensional sculpted form and which sculpted surfaces in the aggregate and upon assembly of the puzzle pieces into predetermined positions form solely a predetermined single intelligible three-dimensional representation, with any other assembly of said pieces forming a non-intelligible three-dimensional configuration;

the side surfaces of said puzzle pieces extending linearly in lateral directions and being free of any means, including interlocks between said side surfaces, which would indicate the location and orientation of any puzzle piece in the final assembly of the puzzle, each side surface of each puzzle piece adjacent another puzzle piece abutting and lying in conformal relation with a side surface of said adjacent puzzle piece without any interlock therebetween upon assembly of said puzzle pieces, the bottom surface of each said puzzle piece having an interlocking part, said bottom surface and said interlocking part of each puzzle piece being identical in shape to the shapes of the bottom surface and interlocking part of each other puzzle piece, respectively, and being free of any means which would indicate the location and orientation of any puzzle piece in the final assembly of the puzzle;

a base underlying the puzzle piece and carrying a plurality of elements cooperable with said interlocking parts to retain said pieces in said predetermined assembly with said side surfaces abutting one another, the interlocking part no each said puzzle piece being cooperable with an element on said base to establish fixed, non-rotational orientation of said puzzle piece upon application thereof on said base, said base being free of any means, including said elements, which would indicate the location and orientation of any puzzle piece in the final assembly of the puzzle; and said interlocking part on each said puzzle piece including means defining a slot opening through said bottom surface, each of said base elements including an upstanding rib for reception in said slot upon application of a puzzle piece on said base.

17. A three-dimensional puzzle piece according to claim 16 wherein each of said puzzle pieces includes discrete side walls having lower edges, said interlocking part including means defining a slot in each of said edges opening through said bottom surface, each of said edges including ribs upstanding from said base for reception in said slots upon application of said puzzle piece on said base.

18. A three-dimensional puzzle according to claim 17 wherein said puzzle piece is hollow.

19. A three-dimensional puzzle according to claim 16 wherein said puzzle piece is formed of solid material.

20. A three-dimensional puzzle for forming solely a single intelligible three-dimensional representation, comprising:

a plurality of puzzle pieces identical both in geometric form and size in plan and having top, bottom, and side surfaces, the top surface of each puzzle piece being in three-dimensional sculpted form and which sculpted surfaces in the aggregate and upon assembly of the puzzle pieces into predetermined positions form solely a predetermined single intelligible three-dimensional representation, with any other assembly of said pieces forming a non-intelligible three-dimensional configuration;

the side surfaces of said puzzle pieces extending linearly in lateral directions and being free of any means, including interlocks between said side surfaces, which would indicate the location or orientation of any puzzle piece in the final assembly of the puzzle, each side surface of each puzzle piece adjacent another puzzle piece abutting and lying in conformal relation with a side surface of said adjacent puzzle piece without any interlock therebetween upon assembly of said puzzle pieces, the bottom surface of each said puzzle piece having an interlocking part, said bottom surface and said interlocking part of each puzzle piece being identical in shape to the shapes of the bottom surface and interlocking part of each other puzzle piece, respectively, and being free of any means which would indicate the location or orientation of any puzzle piece in the final assembly of the puzzle; and a base underlying the puzzle piece and carrying a plurality of elements cooperable with said interlocking parts to retain said pieces in said predetermined assembly with said side surfaces abutting one another, said base being free of any means, including said elements, which would indicate the location or orientation of any puzzle piece in the final assembly of the puzzle, said base having a surface for receiving said puzzle pieces, at least a portion of said base surface having a three-dimensional configuration and which base surface portion, when the puzzle pieces are assembled to form the puzzle, forms with said assembled puzzle pieces part of a continuous three-dimensional representation.

21. A three-dimensional puzzle for forming solely a single intelligible three-dimensional representation, comprising:

a plurality of puzzle pieces identical both in geometric form and size in plan and having top, bottom, and side surfaces, the top surface of each puzzle piece being in three-dimensional sculpted form and which sculpted surfaces in the aggregate and upon assembly of the puzzle pieces into predetermined positions form solely a predetermined single intelligible three-dimensional representation, with any other assembly of said pieces forming a non-intelligible three-dimensional configuration;

the side surfaces of said puzzle pieces extending linearly in lateral directions and being free of any means, including interlocks between said side surfaces, which would indicate the location or orientation of any puzzle piece in the final assembly of the puzzle, each side surface of each puzzle piece adjacent another puzzle piece abutting and lying in conformal relation with a side surface of said adjacent puzzle piece without any interlock therebetween upon assembly of said puzzle pieces, the bottom surface of each said puzzle piece having an interlocking part, said bottom surface and said interlocking part of each puzzle piece being identical in shape to the shapes of the bottom surface and interlocking part of each other puzzle piece, respectively, and being free of any means which would indicate the location or orientation of any puzzle piece in the final assembly of the puzzle; and a base underlying the puzzle piece and carrying a plurality of elements cooperable with said interlocking parts to retain said pieces in said predetermined assembly with said side surfaces abutting one another, said base being free of any means, including said elements, which would indicate the location or orientation of any puzzle piece in the final assembly of the puzzle, said base having surface portions which are flat and form tiers at different elevations relative to one another.

22. A three-dimensional puzzle for forming solely a single intelligible three-dimensional representation, comprising:

a plurality of puzzle pieces identical in geometric form in plan and having top, bottom, and side surfaces, the top surface of each puzzle piece being in three-dimensional sculpted form and which sculpted surfaces in the aggregate and upon assembly of the puzzle pieces into predetermined positions form solely a predetermined single intelligible three-dimensional representation, with any other assembly of said pieces forming a non-intelligible three-dimensional configuration;

the side surfaces of said puzzle pieces extending linearly in later directions and being free of any means, including interlocks between said side surfaces, which would indicate the location and orientation of any puzzle piece in the final assembly of the puzzle, each side surface of each puzzle piece adjacent another puzzle piece abutting and lying conformal relation with a side surface of said adjacent puzzle piece without any interlock therebetween upon assembly of said puzzle pieces, the bottom surface of each said puzzle piece having an interlocking part, said bottom surface and said interlocking part of each puzzle piece being identical in shape to the shapes of the bottom surface and interlocking part of each other puzzle piece, respectively, and being free of any means which would indicate the location or orientation of any puzzle piece in the final assembly of the puzzle; and a base underlying the puzzle piece and carrying a plurality of elements cooperable with said interlocking parts to retain said pieces in said predetermined assembly with said side surfaces abutting one another, said base being free of any means, including said elements, which would indicate the location and orientation of any puzzle piece in the final assembly of the puzzle, said base having surface portions which are flat and form tiers at different elevations relative to one another.

* * * * *